US007950110B2

(12) United States Patent
Leder et al.

(10) Patent No.: US 7,950,110 B2
(45) Date of Patent: May 31, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Armin Leder, Mönchengladbach (DE); Gerd Pferdmenges, Jüchen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 397 days.

(21) Appl. No.: 12/163,127

(22) Filed: Jun. 27, 2008

(65) Prior Publication Data

US 2009/0000067 A1 Jan. 1, 2009

(30) Foreign Application Priority Data

Jun. 29, 2007 (DE) ..... 10 2007 030 471
Jun. 29, 2007 (DE) ..... 20 2007 010 686 U
Dec. 7, 2007 (DE) ..... 10 2007 059 249

(51) Int. Cl.
*D01G 19/00* (2006.01)

(52) U.S. Cl. ..... 19/217

(58) Field of Classification Search ..... 19/115 R, 19/128, 161.1, 215, 216, 217, 296
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,044,460 A 6/1936 Bartram et al.
2,962,772 A * 12/1960 Draving et al. ..... 19/163
3,108,333 A * 10/1963 Schleifer ..... 19/235
4,270,245 A 6/1981 Stewart et al.
5,007,623 A * 4/1991 Unkuri et al. ..... 270/39.05
5,343,686 A 9/1994 Buchner et al.

(Continued)

FOREIGN PATENT DOCUMENTS

DE 367482 C 1/1923

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for the fiber-sorting or fiber-selection of a fiber bundle comprising textile fibers, especially for combing, which is supplied by means of a supply device to a fiber-sorting device, especially a combing device, for removal of the combed fiber material at least one take-off device with a sliver-forming element is present, downstream of which is a drafting system. To increase productivity and obtain an improved combed sliver, downstream of the supply device there are at least two rotatably mounted rollers rotating rapidly without interruption, which are provided with the clamping devices for the fiber bundle, and between the sliver-forming element and the drafting system at least one conveyor element for a formed combed sliver is present.

21 Claims, 8 Drawing Sheets

U.S. PATENT DOCUMENTS

| | | | | |
|---|---|---|---|---|
| 5,404,619 | A | 4/1995 | Jorg | |
| 5,457,851 | A * | 10/1995 | Mondini | 19/115 R |
| 5,502,875 | A * | 4/1996 | Stolz et al. | 19/115 R |
| 5,796,220 | A | 8/1998 | Clapp et al. | |
| 6,163,931 | A | 12/2000 | Leifeld | |
| 6,173,478 | B1 | 1/2001 | Patelli et al. | |
| 6,216,318 | B1 | 4/2001 | Leifeld | |
| 6,235,999 | B1 | 5/2001 | Rubenach | |
| 6,295,699 | B1 | 10/2001 | Temburg | |
| 6,499,194 | B1 | 12/2002 | Gresser et al. | |
| 6,611,994 | B2 | 9/2003 | Bischofberger et al. | |
| 7,173,207 | B2 | 2/2007 | Losbrock et al. | |
| 2002/0124354 | A1 | 9/2002 | Pferdmenges et al. | |
| 2003/0005551 | A1 | 1/2003 | Schurenkramer et al. | |
| 2003/0029003 | A1 | 2/2003 | Breuer et al. | |
| 2003/0070260 | A1 | 4/2003 | Rubenach | |
| 2003/0154572 | A1 | 8/2003 | Pferdmenges et al. | |
| 2004/0040121 | A1 | 3/2004 | Schmitz | |
| 2004/0128799 | A1 | 7/2004 | Hosel et al. | |
| 2005/0076476 | A1 | 4/2005 | Temburg | |
| 2005/0198783 | A1 | 9/2005 | Rubenach | |
| 2005/0278900 | A1 | 12/2005 | Dammig | |
| 2006/0260100 | A1 | 11/2006 | Duda et al. | |
| 2007/0180658 | A1 | 8/2007 | Saeger et al. | |
| 2007/0180659 | A1 | 8/2007 | Saeger et al. | |
| 2007/0180660 | A1 | 8/2007 | Saeger et al. | |
| 2007/0266528 | A1 | 11/2007 | Farber et al. | |
| 2008/0092339 | A1 | 4/2008 | Bossman et al. | |
| 2009/0000064 | A1 | 1/2009 | Saeger et al. | |
| 2009/0000065 | A1 | 1/2009 | Saeger et al. | |
| 2009/0000066 | A1 | 1/2009 | Saeger et al. | |
| 2009/0000068 | A1 | 1/2009 | Saeger et al. | |
| 2009/0000069 | A1 | 1/2009 | Saeger et al. | |
| 2009/0000070 | A1 | 1/2009 | Saeger et al. | |
| 2009/0000071 | A1 | 1/2009 | Saeger et al. | |
| 2009/0000072 | A1 | 1/2009 | Saeger et al. | |
| 2009/0000073 | A1* | 1/2009 | Saeger et al. | 19/115 R |
| 2009/0000074 | A1 | 1/2009 | Bossmann | |
| 2009/0000075 | A1 | 1/2009 | Saeger et al. | |
| 2009/0000076 | A1 | 1/2009 | Bossmann et al. | |
| 2009/0000077 | A1 | 1/2009 | Saeger et al. | |
| 2009/0000078 | A1 | 1/2009 | Saeger et al. | |
| 2009/0000079 | A1 | 1/2009 | Bossmann | |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A1 | 10/2005 |
| WO | WO-2006/012758 | A1 | 2/2006 |

OTHER PUBLICATIONS

German Patent Office Search Report dated Jul. 10, 2007, Issued in related German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

The present application claims priority from German Utility Model Application No. 20 2007 010 686.6 dated Jun. 29, 2007 and German Patent Application No. 10 2007 059 249.5 dated Dec. 7, 2007, the entire disclosure of each of which is incorporated herein by reference.

BACKGROUND OF THE INVENTION

The invention relates to an apparatus for the fibre-sorting or selection of a fibre bundle comprising textile fibres, especially for combing. In a known apparatus, fibre material is supplied by means of a supply device to a fibre-sorting device, especially to a combing device, in which clamping devices are provided, which clamp the fibre bundle at a distance from its free end and mechanical means are present which generate a combing action from the clamping site to the free end of the fibre bundle in order to loosen and remove non-clamped constituents, such as, for example, short fibres, neps, dust and the like from the free end, wherein for removal of the combed fibre material at least one take-off device having a sliver-forming element is present, downstream of which is disposed a drafting system.

In practice, combing machines are used to free cotton fibres or woolen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre bundle and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The lap ribbon supplied to the nipper assembly is here fed via a feed cylinder to a detaching roller pair. The fibre tuft protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre tuft is additionally pulled by the needles of a top comb. The top comb combs out the rear part of the detached fibre tuft and also holds back neps, impurities and the like. The top comb, for which in structural terms space is required between the movable nipper assembly and the movable detaching roller, has to be constantly cleaned by having air blown through it. For piercing into and removal from the fibre sliver, the top comb has to be driven. Finally, the cleaning effect at this site of jerky movement is sub-optimal. Owing to the differences in speed between the lap ribbon and the detaching speed of the detaching rollers, the detached fibre tuft is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre tuft protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed. The fibre slivers F produced at the individual combing heads are delivered by means of a device not shown more specifically onto a conveyor table T and transferred, lying one next to the other, to a subsequent drafting system S. The fibre slivers are drafted in the drafting system S and subsequently combined to form a common combing fibre sliver FB. The conveying speed of the eight fibre slivers on the conveyor table to the drafting system S is matched to the upstream slow combing process and is limited by this, that is, it progresses at relatively low speed. A high, substantially increased conveying speed, in particular without faulty drafts in the eight fibre slivers, is not possible with this conveying device.

SUMMARY OF THE INVENTION

It is am aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre-sorting device;

a supply device for supplying the fibre bundle to the fibre-sorting device;

at least one mechanical device for generating a combing action in order to loosen and remove non-clamped constituents from the fibre bundle;

a take off device for removal of combed fibre material from the fibre-sorting device; and a drafting device, wherein:

the fibre sorting device comprises, arranged downstream of said supply device, at least first and second rotatably mounted rollers that, in use, rotate rapidly without interruption, at least one of which has clamping devices distributed spaced apart in the region of its periphery for clamping the fibre bundle;

said take off device comprises a sliver-forming element for forming a combed sliver; and the apparatus further comprises at least one conveyor element arranged downstream of said sliver-forming element, for conveying the combed sliver to said drafting device.

By implementing the functions of clamping and moving the fibre bundles to be combed-out on at least two rotating rollers, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable which had previously not been considered possible in technical circles. A further advantage is that the rotary rotational movement of the roller with the plurality of clamping devices leads to an unusually rapid supply of a plurality of fibre bundles per unit of time to the first roller and to the second roller. In particular the high rotational speed of the rollers allows production to be substantially increased. To form the fibre bundle, the fibre sliver pushed forward by the feed roller is clamped at one end by a clamping device and detached by the rotary movement of the first roller, which is, for example, a turning rotor.

The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the second roller, which is, for example, a combing rotor, the ends of the fibre bundle are reversed: the clamping device on the second roller grips and clamps the end with the long fibres, so that the region with the short fibres projects from the clamping device and lies exposed and can thereby be combed out. The fibre bundles are—unlike the known apparatus—held by a plurality of clamping devices and transported under rotation.

The clamping point at the particular clamping devices advantageously remains constant until the fibre bundles are transferred to the first and second rollers. A relative movement between clamping device and fibre bundle advantageously does not begin until after the fibre bundle has been gripped by the first and second roller respectively and in addition clamping has been terminated.

Because a plurality of clamping devices is available for the fibre bundles, in an especially advantageous manner fibre bundles can be supplied to the first and second roller respectively one after the other and in quick succession, without undesirable time delays resulting from just a single supply device. A particular advantage is that the supplied fibre bundles on the first roller (turning rotor) may be continuously transported. The speed of the fibre bundle and of the co-operating clamping elements is advantageously the same. The clamping elements advantageously close and open during the movement in the direction of the transported fibre material. The at least one second roller (combing rotor) is, advantageously, arranged downstream of the at least one first roller (turning rotor). With the apparatus according to the invention, a substantially increased productivity is achievable. A further particular advantage is that at high and maximum operating speeds of the rotor combing machine, the single combined fibre sliver produced is typically conveyed without faulty drafts to the drafting system. The operating speed of the downstream drafting system is naturally adapted to the high conveying speed. In addition, insertion of the single fibre sliver into the drafting system without problems is made possible.

In one embodiment, the invention provides an apparatus for combing a fibre bundle in which the fibre-sorting device is a combing device. The non-clamped constituents removed by the combing action of the mechanical devices are, for example, short fibres, neps, dust and the like.

Advantageously, said at least one conveyor element comprises a conveyor belt, for example, a driven, endlessly revolving conveyor belt (belt conveyor). Advantageously, the sliver-forming element comprises delivery rollers. The conveyor belt may be, in some embodiments, arranged immediately after the delivery rollers of the sliver-forming element. The conveyor belt preferably comprises an upper belt portion for carrying fibre sliver.

Advantageously, a pressure element is present close to, preferably opposite, an intake roller of the conveyor belt. For example, a pressure element may be present close to the lower guide roller of an ascending conveyor. In some embodiments the pressure element is a calender roller. In other embodiments the pressure element is a non-moving surface. Advantageously, the pressure element is a force-loaded, for example, the pressure element may be spring-loaded.

Advantageously, a support element with a non-moving surface for supporting the fibre sliver is located downstream of the at least one conveyor element. Preferably, the support element is located between a conveyor belt and the drafting system. Advantageously, a support element with a non-moving surface for the fibre sliver is located between the upper guide roller of the ascending conveyor and the intake rollers of the drafting system. The support element may be, for example, a transfer plate or the like. Advantageously, the surface of the support element is polished. In one embodiment, the support element consists essentially of stainless steel. Advantageously, the support element is capable of introducing the fibre sliver into the roller nip between the intake rollers of the drafting system. Preferably, the introduction is effected from below.

Advantageously, the outlet of the drafting system is arranged above a fibre sliver-deposition device. Advantageously, the outlet is arranged close to the fibre sliver-deposition device. In some embodiments, the fibre sliver-deposition device comprises a funnel.

Optionally, a sliver-expanding device is arranged between conveyor belt and drafting system. Preferably, the sliver-expanding device is arranged shortly before, for example close to in an upstream direction, the drafting system. Advantageously, the fibre sliver is expanded in width to a narrow fibre web by the sliver-expanding device.

Advantageously, the output roller of the drafting system is located close to and laterally above the funnel of the fibre sliver-deposition device.

In some embodiments, the conveyor belt includes an intake roller and/or an output roller. The intake and output rollers are preferably guide rollers for guiding the revolving belt of the conveyor belt. The intake roller is arranged upstream—in the belt running direction—of the output roller, and the belt of the conveyor belt revolves around the intake roller and the output roller. Advantageously, the intake roller of the conveyor belt is located close to the delivery rollers of the sliver-forming element. Advantageously, the output roller of the conveyor belt is located close to the drafting system shortly before the optional sliver-expanding device.

Advantageously, the fibre sliver undergoes compaction on the conveyor belt, for example, by means of a pressure-applying roll. Advantageously, the fibre sliver is fixable on the conveyor belt by virtue of a perforation of the conveyor belt and application of a reduced pressure. In some embodiments the conveyor element functions as, or includes, a silver-expanding device. Advantageously, width expansion of the sliver is effected on the conveyor belt, for example, by a convex delivery roller. Advantageously, devices that limit the width of the narrow fibre sliver are arranged on both sides, for example on both sides of the conveyor belt.

Advantageously, more than one fibre sliver is feedable to the at least one conveyor element. Advantageously, a plurality of fibre slivers are conveyable on the conveyor belt. Preferably, each of the plurality of fibre slivers are delivered by a take-off unit associated therewith.

In some embodiments, the sliver cross-section may be substantially rectangular in the manner of a web strip.

Advantageously, two conveyor belts arranged above one another in the longitudinal direction and running obliquely upwards are present, which convey the fibre sliver upwards and between which the fibre sliver is pressed.

Advantageously, the at lest one conveyor element comprises at least one calender roller. Advantageously, two co-operating calender rollers (pressure-applying and conveying rollers) are arranged upstream of the conveyor belt.

In some embodiments, at least one conveyor element comprises a sheet-like element with a non-moving surface, for example, a metal sheet or the like. At least one sheet-like element may, for example, be inclined obliquely upwards or arranged substantially horizontally. In some embodiments, the sheet-like element is arranged immediately upstream or immediately downstream of two calender rollers, for example a pair of co-operating calender rollers. Advantageously, immediately upstream of a sheet-like element are mounted two calender rollers, said sheet-like element preferably being inclined obliquely upwards. A sheet-like element may, optionally, be arranged upstream of two co-operating calender rollers, said sheet-like element preferably being arranged substantially horizontally. In one embodiment, an ascending conveyor is arranged downstream of a sheet-like element.

Advantageously, the conveyor belt (belt conveyor) includes at least one horizontal and at least one sloped region. In one embodiment the horizontal region—in the belt running direction—is provided upstream of the sloped region. In another embodiment the horizontal region—in the belt running direction—is provided downstream of the sloped region. Advantageously, a spring-loaded plate or the like that is arranged above the sloped region presses the ascending fibre sliver onto the upper belt portion of the conveyor belt.

Advantageously, a belt guide roller is associated with the upper belt of the conveyor belt. For example, the belt guide roller may be provided at the transition between the horizontal and the sloped region of the conveyor belt.

In one embodiment, the conveyor element formed from a conveyor belt is of one-piece construction. In another embodiment the conveyor belt comprises at least two separate conveyor belts. Advantageously, a fixed plate or the like is present between the conveyor belts. In some embodiments, the fixed-plate is a sheet-like element. Preferably, a sliver guide roller, for example a calender roller, is associated with the fixed plate. Optionally, the sliver guide roller is force-loaded, for example, by a spring.

In some embodiments, the apparatus comprises a turning rotor and a combing rotor, For example, the first rotatably mounted roller may be a turning rotor and the second rotatably mounted roller may be a combing rotor. Advantageously, the turning rotor and a combing rotor have opposing directions of rotation.

The invention further provides an apparatus for the fibre-sorting or fibre-selection of a fibre bundle comprising textile fibres, which is supplied by means of a supply device to a fibre-sorting device, in which clamping devices are provided which clamp the fibre bundle at a clamping site at a distance from a free end of the fibre bundle, and mechanical devices are present which generate a combing action from the clamping site to the free end of the fibre bundle in order to loosen and remove non-clamped constituents, such as, for example, short fibres, neps, dust and the like from the free end, wherein for removal of the combed fibre material at least one take-off device with a sliver-forming element is present, downstream of which is a drafting system, wherein downstream of the supply device there is arranged at least a first and a second rotatably mounted roller that rotate rapidly without interruption, at least one of which is provided with clamping devices for clamping the fibre bundle, which clamping devices are distributed spaced apart in the region of the periphery of the at least one rotatably mounted roller, and between the sliver-forming element and the drafting system at least one conveyor element for a formed combed sliver is present. Advantageously, said at least one conveyor element is a driven ascending conveyor.

DETAILED DESCRIPTION OF CERTAIN EMBODIMENTS

Figure 1:
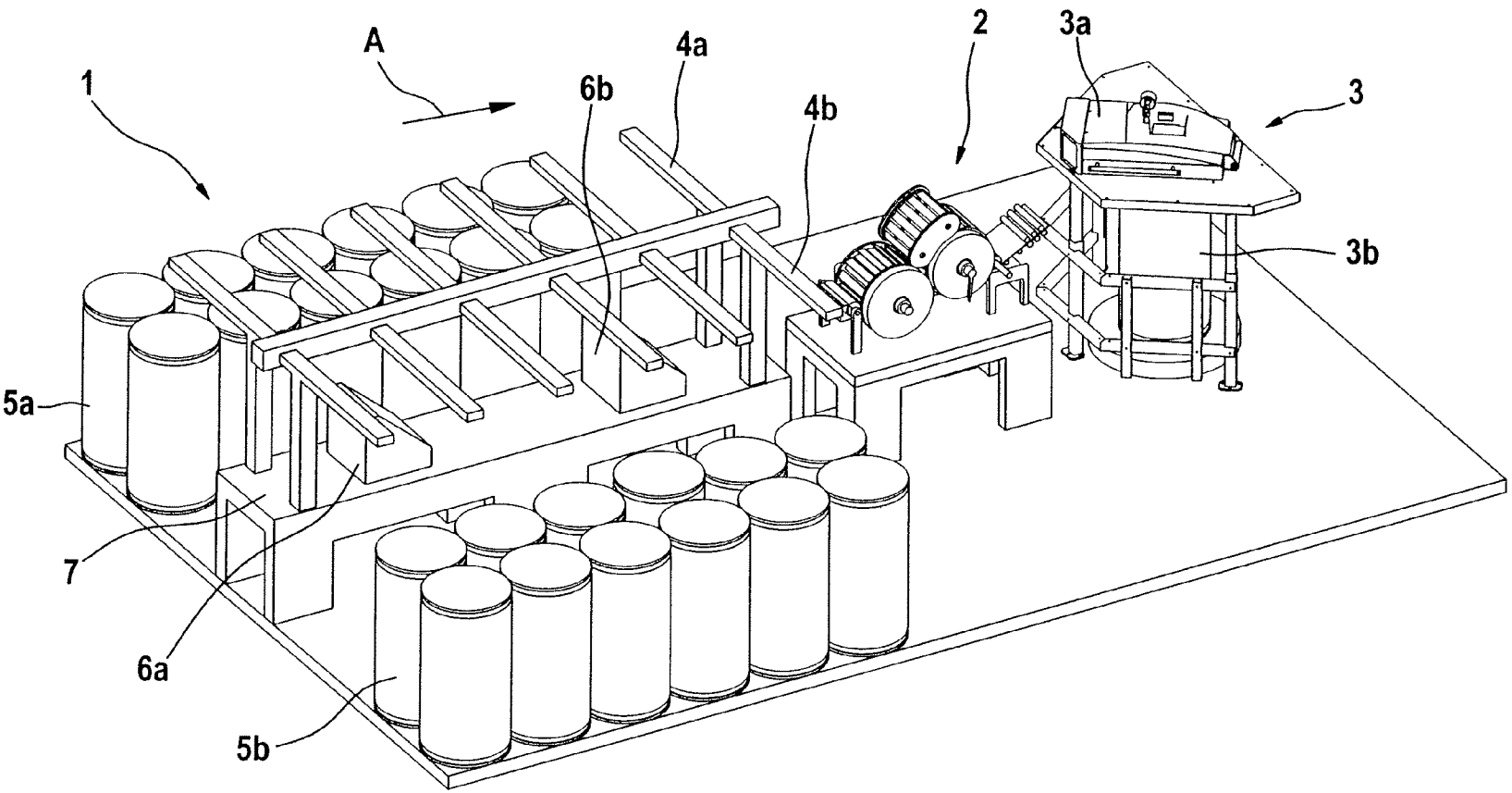
FIG. 1 is a diagrammatic perspective view of a device for combing fibre material, comprising a combing preparation device, a rotor combing machine and a sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further construction, more than one rotor combing machine 2 is provided. If, for example, two rotor combing machines are present, then the two delivered comber slivers 17 can pass together through the downstream autoleveller drafting system 50 and be deposited as a drafted comber sliver in the sliver-deposition device 3.

The sliver-deposition device 3 comprises a rotating coiler head 3*a*, by which the comber sliver can be deposited in a can 3*b* or (not shown) in the form of a canless fibre sliver package.

Figure 2:
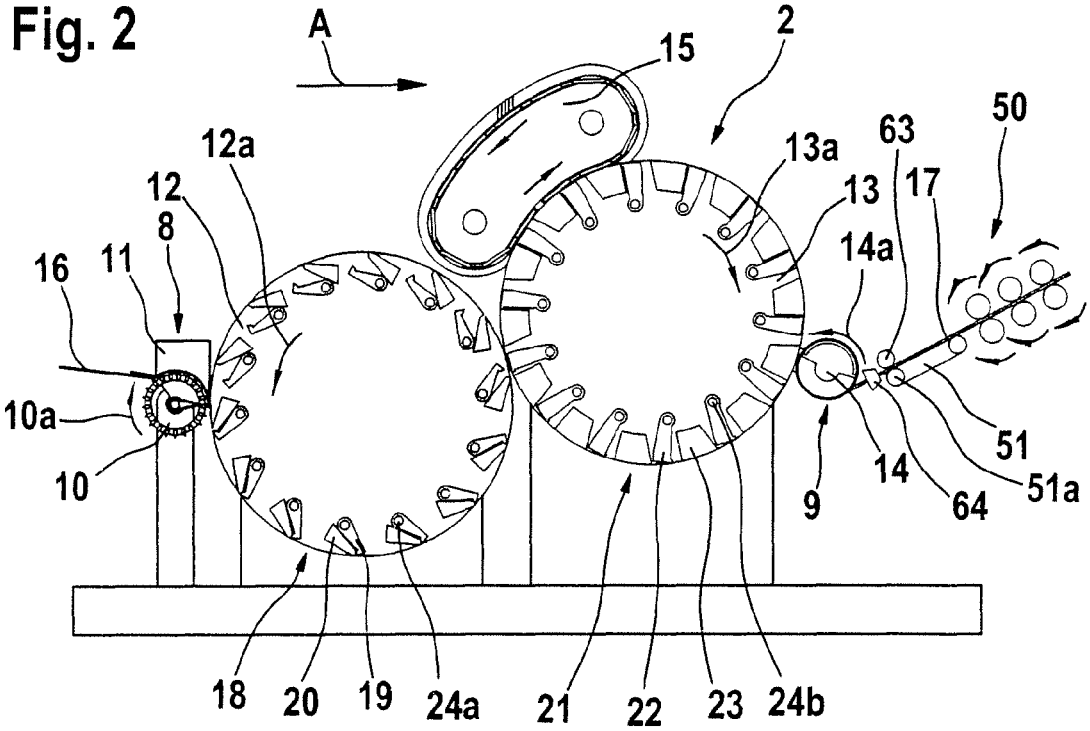
FIG. 2 is a diagrammatic side view of a rotor combing machine according to the invention having two rollers and two combing elements.

FIG. 2 shows a rotor combing machine 2 having a supply device 8 comprising a feed roller 10 and a feed trough 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted (see FIG. 12) on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a bundle of fibre (not shown) from fibre sliver 16, (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed or movable. The free end of the upper nipper 22 faces the periphery of the roller 13. The upper nipper 22 and the lower nipper 23 co-operate so that they are able to grip a fibre bundle (clamping) and release it. In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the take-off roller (doffer) 14 and the first roller 12 the clamping devices 21 are open.

To form the fibre bundle, the fibre sliver 16 pushed forward by the feed roller 10 is clamped at one end by clamping device 18 and detached by the rotary movement of the first rotor (turning rotor) 12. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the first rotor (turning rotor) 12 onto the second rotor (combing rotor) 13 the ends of the fibre bundle are reversed: the clamping device 21 on the second rotor (combing rotor) 13 grips and clamps the end with the long fibres, so that the region with the short fibres projects from the clamping device 21 and lies exposed and can thereby be combed out.

Reference numeral 50 denotes a drafting system, for example an autoleveller drafting system. The drafting system 50 is advantageously arranged above the coiler head 3*a*. Reference numeral 51 denotes, as conveyor element for conveying the combed fibre material to the drafting device, a driven ascending conveyor, for example a conveyor belt. Close to the lower guide roller (in take roller) 51*a* of the conveyor belt 51*a* calender roller 63 is provided as a pressure-applying element, the fibre sliver 17 being conveyed between the calender roller 63 and the upper belt portion of the conveyor belt 51. Upstream of the conveyor belt 51, a sliver funnel 64 is mounted as sliver-forming element, the outlet of which extends into the gap between the calender roller 63 and the upper belt portion of the conveyor belt 51, or with regard to the pressing action, into the roller nip between the calender roller 63 and the lower guide roller 51*a*. It is also possible to use an upwardly inclined metal sheet or the like for conveying purposes.

Figure 3:
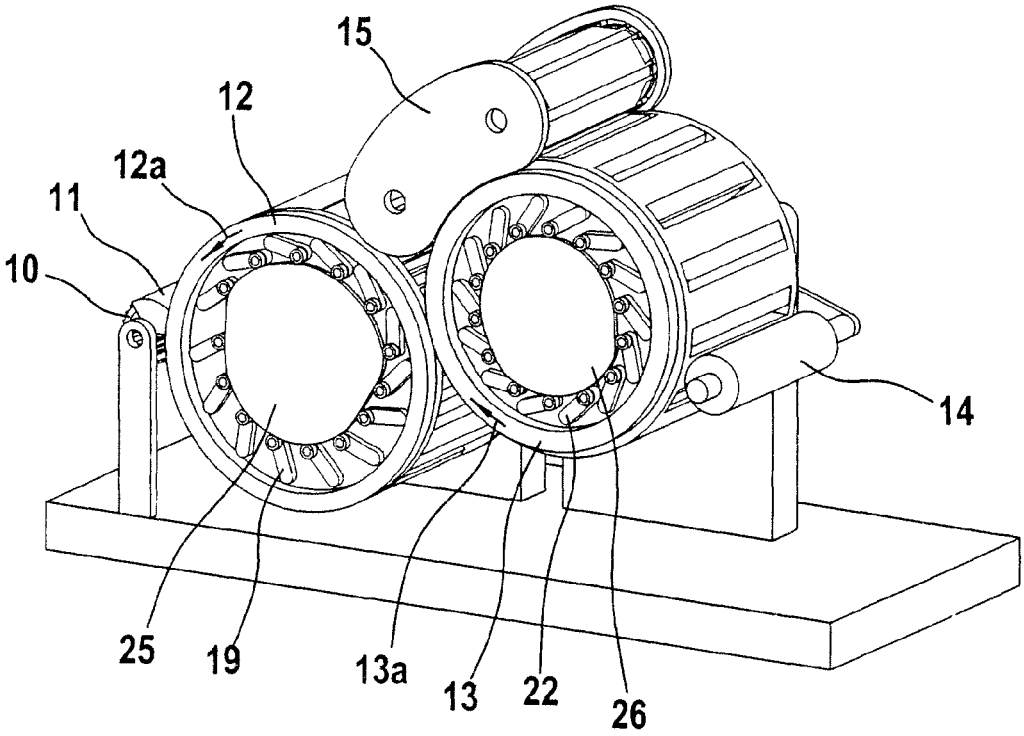
FIG. 3 is a perspective view of the rotor combing machine according to FIG. 2 having two cam discs.

In an embodiment shown in FIG. 3, the rollers 12, 13 of the fibre-sorting device 2 have two fixed cam discs 25 and 26, about which the roller 12 having the first clamping devices 18 and the roller 13 having the second clamping device 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26 respectively, the upper nippers 19 and 22 are rotated about pivot axes 24*a* and 24*b*, respectively. In that way, the opening and closing of the first clamping devices 18 and the second clamping devices 21 is implemented.

Figure 4:
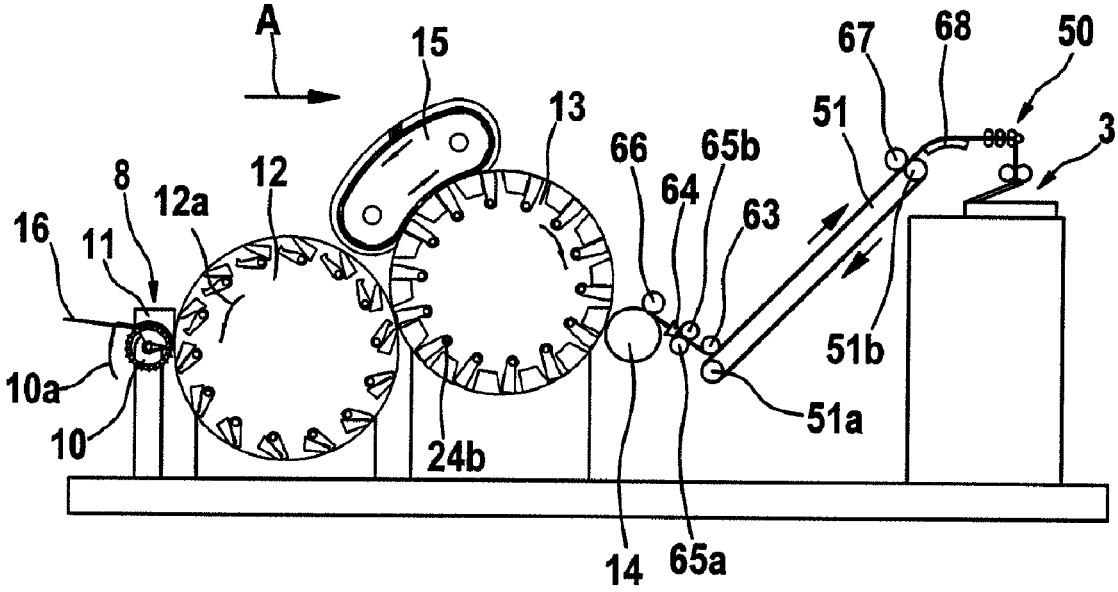
FIG. 4 shows an embodiment with ascending conveyor, pressure-applying rollers and upstream sliver-forming element.

In the embodiment of FIG. 4, as the sliver-forming element a sliver funnel 64 with two downstream calender rollers 65*a*, 65*b* is arranged between the conveyor belt 51 and the take-off roller 14. A pressure-applying roller 66 is associated with the take-off roller 14. Furthermore, close to the upper guide roller 51*b* of the conveyor belt 51*a* calender roller 67 is present as a pressure-applying element. Between the upper guide roller (output roller) and the intake rollers of the drafting system 50 there is a support element 68, over the preferably curved and polished surface of which the fibre sliver 17 runs.

A driven, endlessly revolving conveyor belt (belt conveyor) is present, which in the example shown is a driven ascending conveyor. The conveyor belt is arranged immediately after the delivery rollers of the sliver-forming element. As a pressure element a calender roller 63, which is force-loaded, e.g. by spring, is arranged close to the lower guide roller 51*a* of the conveyor belt 51. The support element 68 with non-moving surface for the fibre sliver 17 is located between the upper guide roller 51*b* of the ascending conveyor 51 and the intake rollers of the drafting system 50. The support element 68 is a transfer plate or the like, the surface of which is polished. Advantageously, the support element 68 consists of stainless steel. The support element 68 is able to introduce the fibre sliver 17 into the roller nip between the intake rollers of the drafting system. The outlet of the drafting system 50 is arranged above and close to the fibre sliver-deposition device 3. The feed roller (intake roller) 51*a* of the conveyor belt 51 is located close to the delivery rollers 65*a*, 65*b* of the sliver-forming element 64. The output roller 51*b* of the conveyor belt 51 is located close to the drafting system 50. The fibre sliver 17 undergoes a compaction on the conveyor belt 51, for example, by means of the pressure-applying roll 63.

Figure 5:
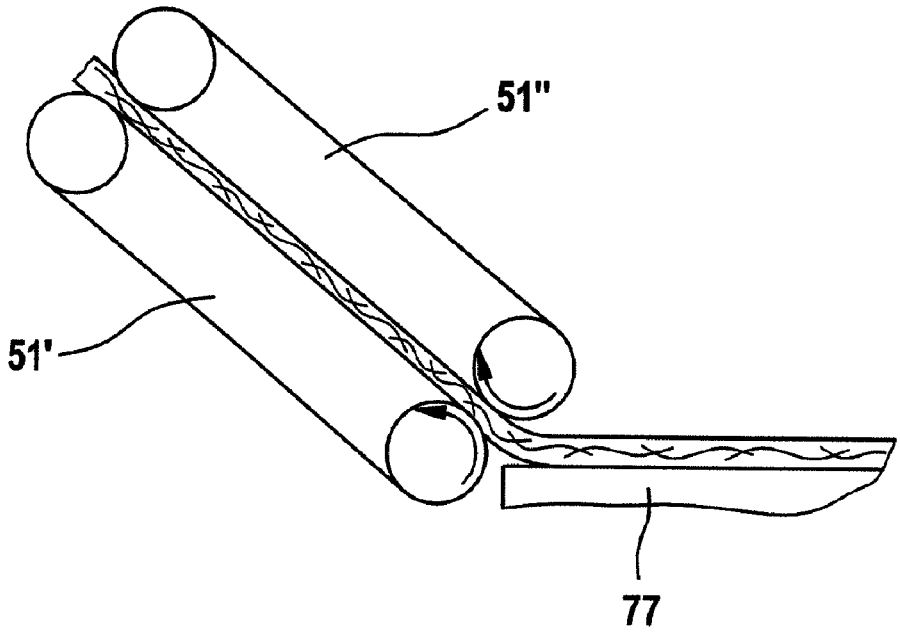
FIG. 5 shows an embodiment with two co-operating conveyor belts.

In the embodiment of FIG. 5, two conveyor belts 51', 51", arranged above one another in the longitudinal direction and running obliquely upwards are present, which convey the fibre sliver 17 upwards and between which the fibre sliver 17 is subjected to pressure.

Figure 6:
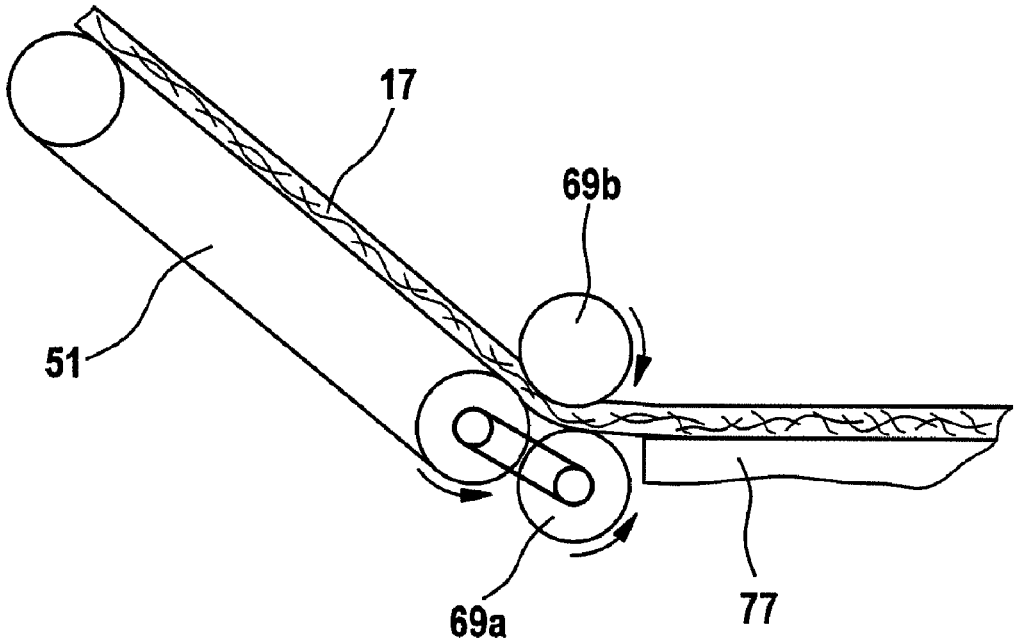
FIG. 6 shows an embodiment with two calender rollers upstream of the ascending conveyor.

In the embodiment of FIG. 6, two co-operating calender rollers 69*a* to 69*b* (pressure-applying and conveying rollers), which convey the fibre sliver 17 in the direction of the conveyor belt 51, are arranged upstream of the conveyor belt 51.

Figure 7:
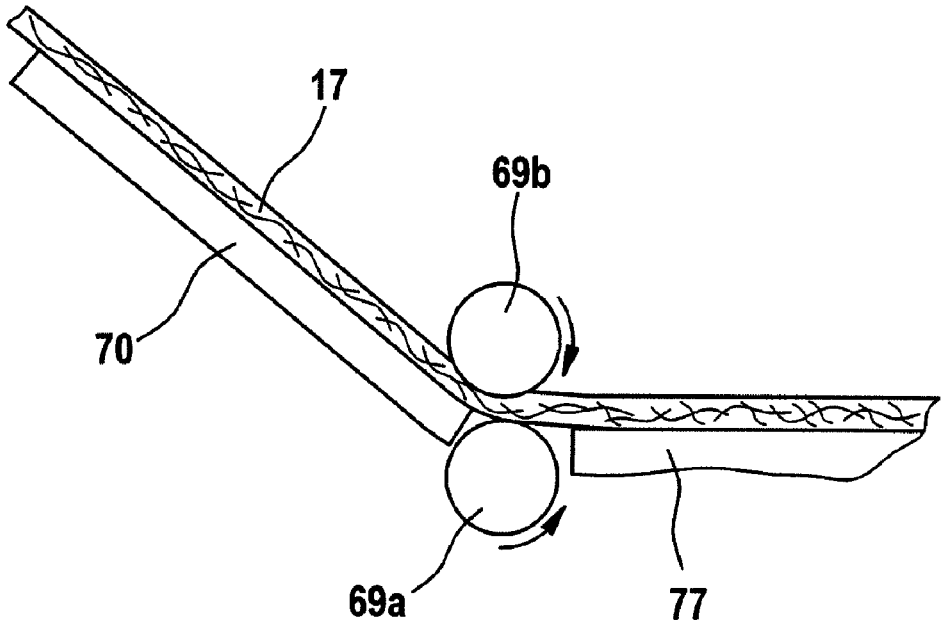
FIG. 7 shows an embodiment with two calender rollers upstream of a support plate.

In the embodiment of FIG. 7, the conveyor element comprises a sheet-like element 70 with non-moving surface, for example, a metal sheet or the like, immediately upstream of which are mounted two calender rollers 69*a*, 69*b*. The fibre sliver 17 is drawn forwards by the calender roller 69*a*, 69*b* onto the sheet-like element 70 and by the intake rollers of the drafting system 50 (see FIG. 2) onto the surface of the sheet-like element 70. The sheet-like element is preferably inclined obliquely upwards.

Figure 8:
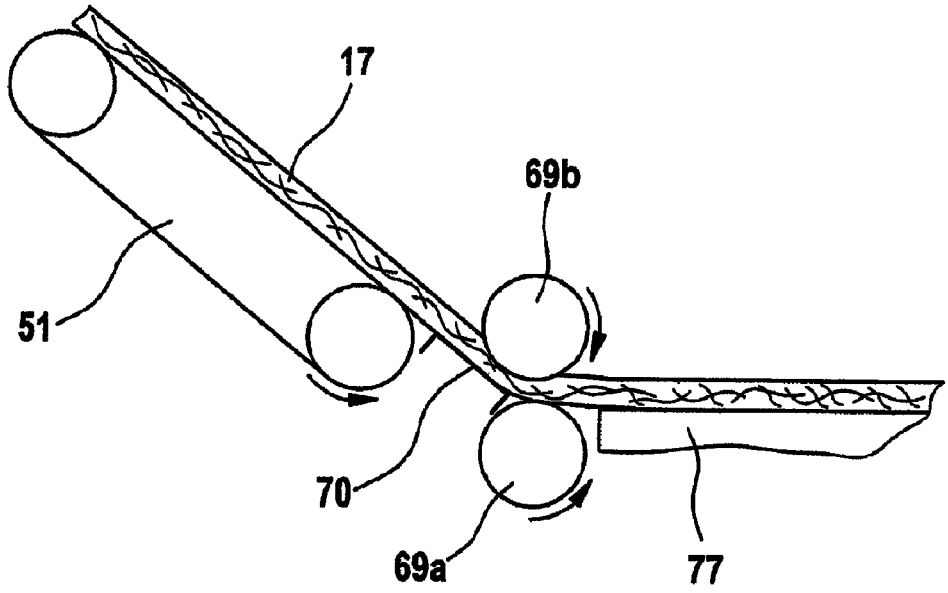
FIG. 8 shows an embodiment generally as in FIG. 7, but with a downstream ascending conveyor.

FIG. 8 shows a construction as in FIG. 7, but in which an ascending conveyor 51 is arranged downstream of the sheet-like element 70.

Figure 9:
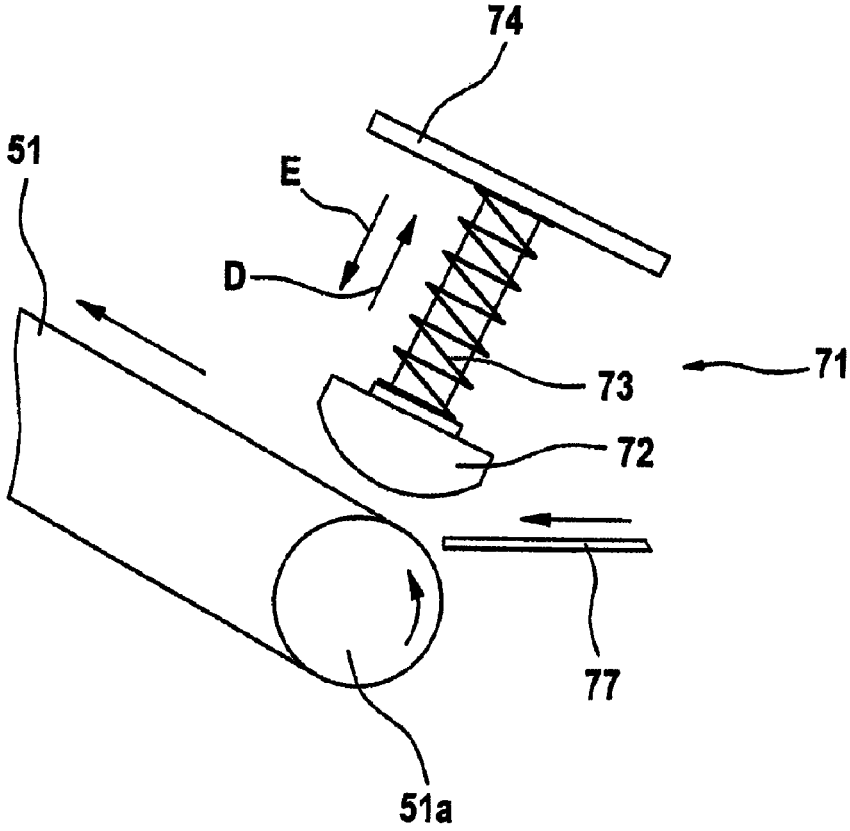
FIG. 9 shows an embodiment with a non-moving surface positioned close to a lower guide roller of the conveyor belt.

In the embodiment of FIG. 9, the ascending conveyor 51 conveys the fibre sliver 17 (not shown) on its upper belt portion upwards to the drafting system 50. So that the fibre sliver 17 is retained better on the upper belt portion of the ascending conveyor 51, a pressure element 71 is provided, the outwardly convexly curved, polished boss 72 of which is loaded by a compression spring 73, which is supported against a fixed-position bearing 74. The boss 72 of the pressure element 71 is displaceable in directions D and E. The boss 71 is positioned opposite the lower guide roller 51*a*. The pressure element 72 has a non-moving surface and is force-loaded by the spring 73.

Figure 10:
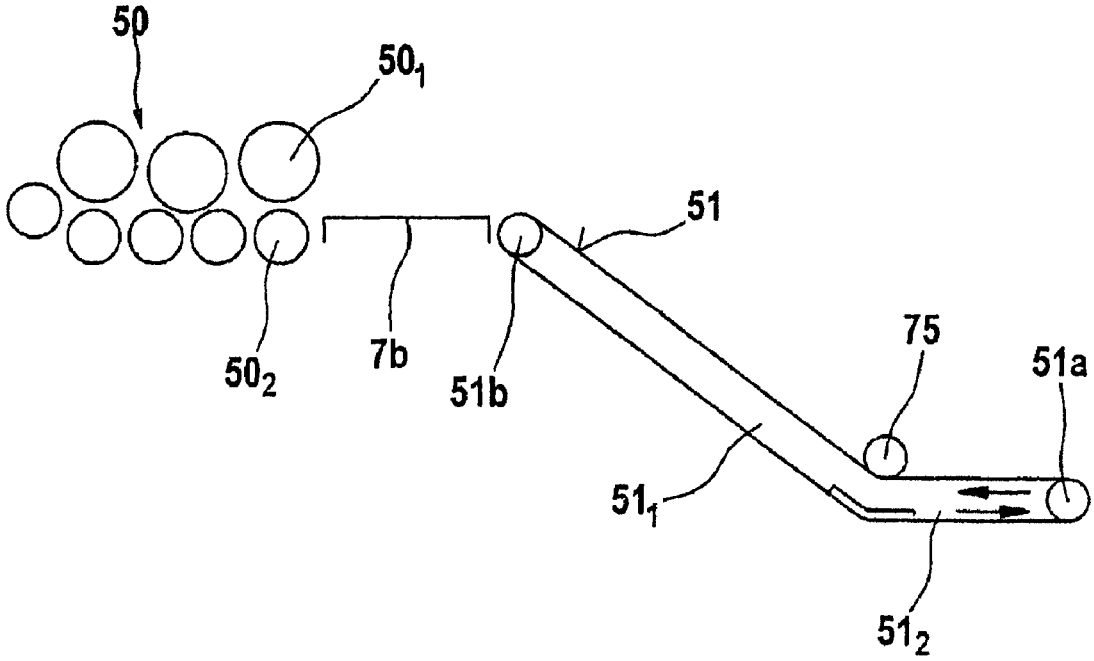
FIG. 10 shows an embodiment in which a horizontal belt region is arranged upstream of an ascending belt portion.

In the embodiment of FIG. 10, conveyor belt 51 that is of one-piece construction and includes a horizontal region $51_2$ and an obliquely arranged region $51_1$ (ascending conveyor) extends from the rotor combing machine (see FIG. 2) as far as the downstream drafting system 50. The conveyor belt 51 consists of an endlessly revolving conveyor belt 51, which revolves around a lower guide roller 51*a* and around an upper guide roller 51*b*. At the transition between the region $51_1$ and $51_2$ a guide roller 75 is associated with the upper belt portion. A support element 7*b* with non-moving surface is arranged between the upper guide roller 51*b* and the intake rollers $50_1$, $50_2$ of the drafting system 50 at a distance. After the upper guide roller 51*b*, the fibre sliver 17 passes over the support plate 7*b* into the roller nip between the intake rollers $50_1$, $50_2$ of the drafting system 50. This means that the fibre sliver 17 is conveyed on the conveyor element as far as the downstream drafting system 50.

Figure 11:
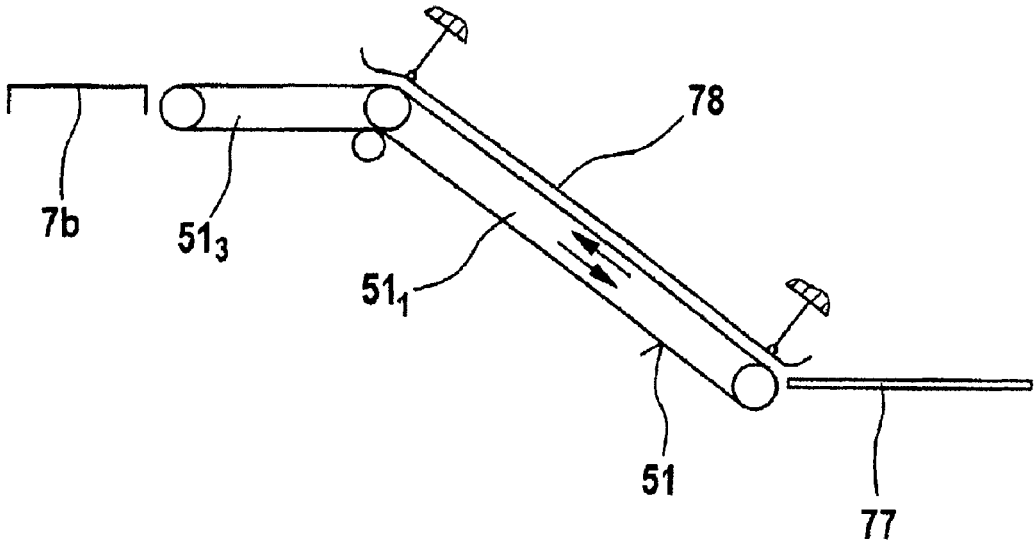
FIG. 11 shows an embodiment in which a horizontal belt region is arranged downstream of an ascending belt region.

In the embodiment of FIG. 11, a spring-loaded plate 78 or the like is arranged above the sloped region $51_1$ of the conveyor belt 51, which plate presses the ascending fibre sliver 17 onto the upper belt portion of the conveyor belt 51.

In the embodiments of FIGS. 10 and 11, the conveyor belt (belt conveyor) includes at least one horizontal and one sloped region. In the embodiment of FIG. 10, the horizontal region $51_2$—in the belt running direction—is provided upstream of the sloped region $51_1$ and in the embodiment of FIG. 11 the horizontal region $51_3$—in the belt running direction—is provided downstream of the sloped region $51_1$. A construction (not shown) is also included in which a horizontal region $51_2$, $51_3$ is provided upstream and downstream of the sloped region $51_1$.

In the embodiments of FIGS. 5 to 11, a sheet-like element 77 with non-moving surface, for example, a metal sheet or the like, is mounted upstream of the conveyor belt 51 or the calender rollers 69*a*, 69*b*. The upstream sheet-like element 77 is substantially horizontally arranged. The fibre sliver 17 runs on the surface, preferably polished, of the sheet-like element 77, for example, a metal sheet or the like.

Using the rotor combing machine 2 according to the invention, more than 2000 nips/min, for example from 3000 to 5000 nips/min, are achieved.

Figure 12:
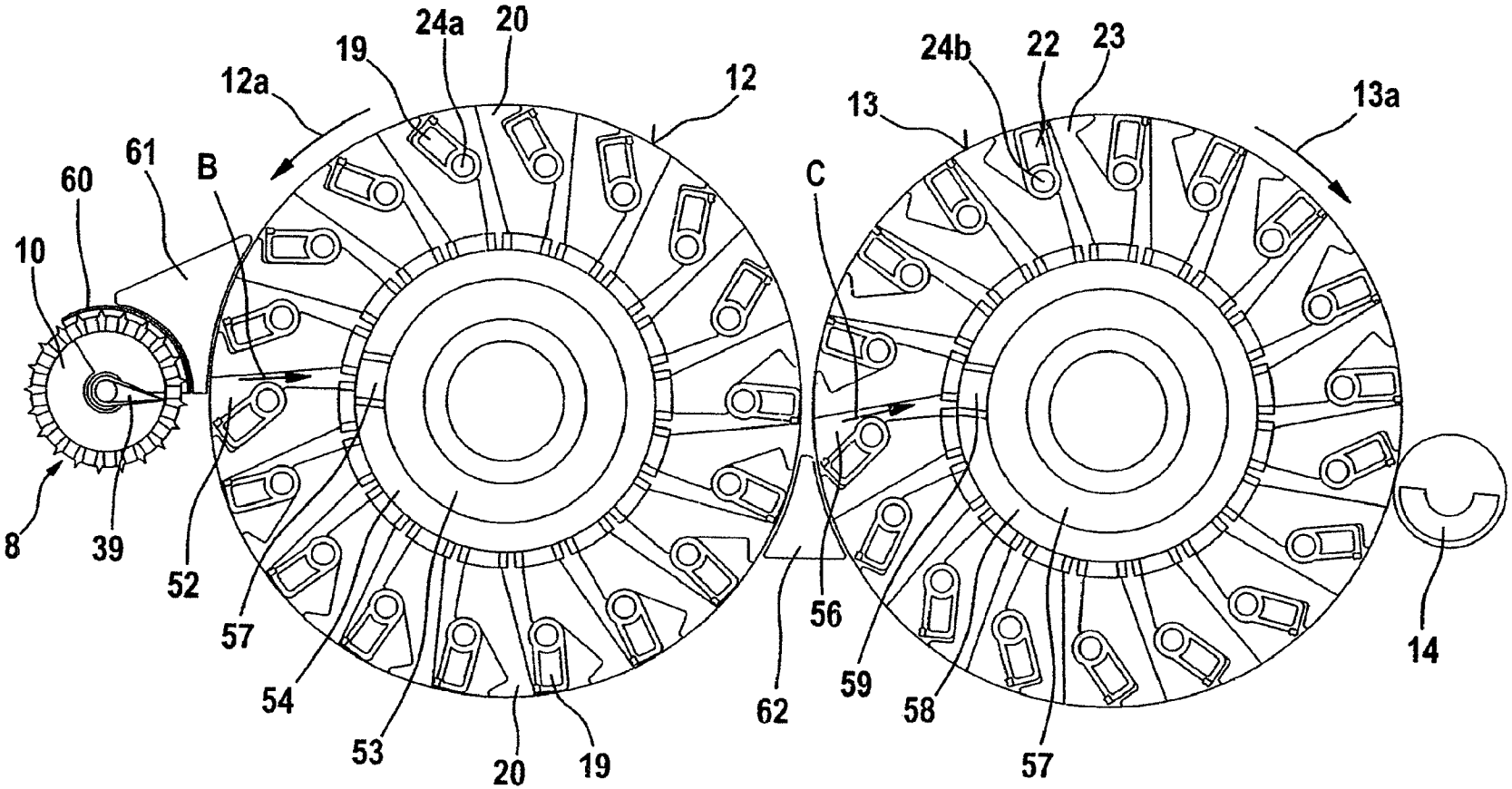
FIG. 12 shows a rotor combing machine usable in accordance with the invention, in which suction devices are associated with the clamping devices.

FIG. 12 shows a further possible arrangement for the rollers 12 and 13 of the fibre-sorting device 2, which arrangement may be used in combination with any of the exemplary embodiments of the conveyor shown in FIGS. 4 to 11. In the rotor combing arrangement of FIG. 12, the rotatably mounted rollers 12 and 13 with clamping devices 19, 20 and 22, 23 are equipped additionally with suction channels 52 and 56, respectively (suction openings), which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper).

In the interior of the rotors 12, 13 there is an reduced pressure region 53 to 55 and 57 to 59, respectively, created by the suction flow at the suction openings 52, 56. The reduced pressure can be generated by connecting to a flow-generating machine. The suction flow at the individual suction openings 52, 56 can be switched between the reduced pressure region and suction opening so that it is applied only at particular selected angular positions on the roller circumference. For the purpose of the switching, valves or a valve pipe 54, 58 with openings 57 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a blowing flow can be provided in the region of the supply device 8 and/or in the region of transfer between the rollers. The source of the blowing flow (blowing nozzle 39) is arranged inside the feed roller 10 and has effect, through the air-permeable surface of the supply device or air passage openings, towards the outside in the direction of the first roller.

Also, in the region of the supply device 8, the element for producing the blown air flow can be fixedly arranged, directly under or over the supply device 8. In the region of the transfer between the rollers 12, 13 the blown air current sources can be arranged at the perimeter of the first roller 12, directly under or over each nipper device. For the blown air generation there may be used compressed air nozzles or air blades.

The suction flows B, C can favourably influence and shorten not only the guiding, but also the separation process between the lap and the bundle to be removed in the region of the supply device 8.

As a result of the provision of additional air guide elements 60 and lateral screens 61, 62 the direction of the flow can be influenced and the air carried round with the rotors separated off. In that way the time for alignment can be further shortened. In particular, a screen element between the first rotor 12 and supply device 8 over the lap and a screen element on each side of the roller have proved useful.

The combed out fibre portion passes from the second roller 13 onto the piecing roller 14.

Figure 13:
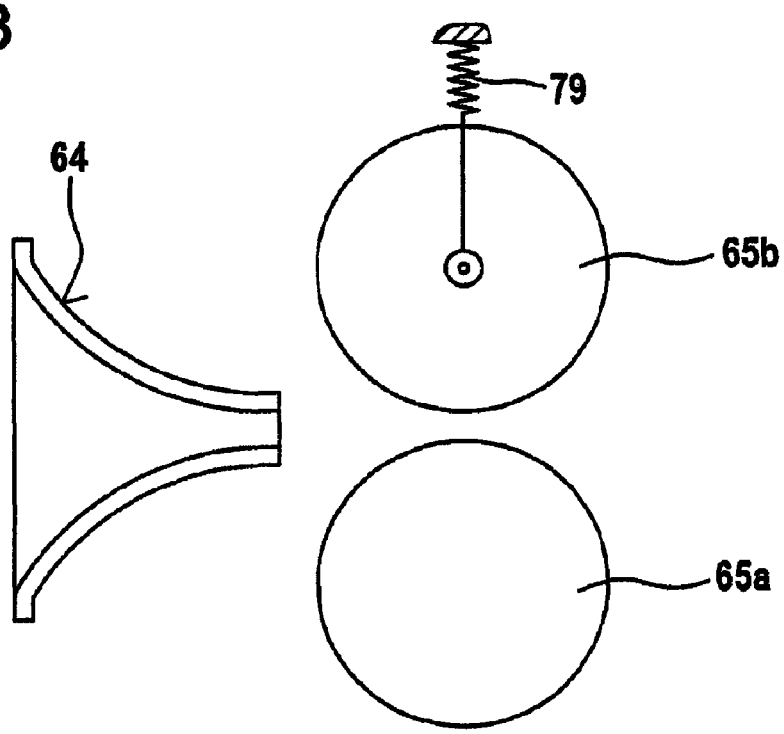
FIG. 13 is a diagrammatic side view of a sliver-forming unit with sliver funnel and delivery rollers.

FIG. 13 shows the sliver-forming element comprising sliver funnel 64 and delivery rollers 65*a*, 65*b*. The delivery roller 65*b* is movably mounted owing to loading by a spring 79.

Figure 14:
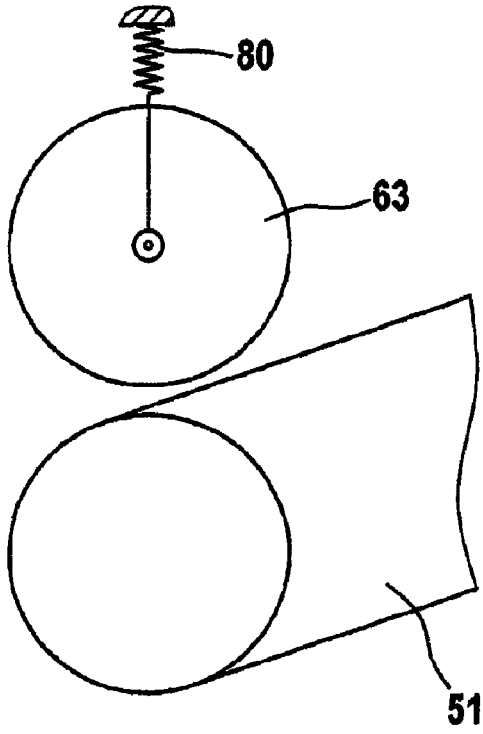
FIG. 14 shows a pressure-applying roller loaded by a spring on an upper belt region of a conveyor belt.

In the embodiment of FIG. 14, the pressure-applying roller 63 (see FIG. 4) is movably mounted owing to loading by a spring 80.

In use of the rotor combing machine according to the invention there is achieved a mechanical combing of the fibre material to be combed, that is, mechanical means are used for the combing. There is no pneumatic combing of the fibre material to be combed, that is, no air currents, e.g. suction and/or blown air currents, are used.

In the rotor combing machine according to the invention there are present rollers that rotate rapidly without interruption and that have clamping devices. In preferred embodiments of the invention, rollers that rotate with interruptions, stepwise or alternating between a stationary and rotating state are not used.

The circumferential speeds are, for example, for the feed roller 10 about from 0.2 to 1.0 m/sec; the first roller 12 about from 2.0 to 6.0 m/sec; the second roller 13 about from 2.0 to 6.0 m/sec; the take off roller 14 about from 0.4 to 1.5 m/sec; and the revolving card top combing assembly 15 about from 1.5 to 4.5 m/sec. The diameter of the first roller 12 and the second roller 13 is, for example, about from 0.3 m to 0.8 m.

Although the foregoing invention has been described in detail by way of illustration and example for purposes of understanding, it will be obvious that changes and modifications may be practised within the scope of the appended claims.

The invention claimed is:

1. An apparatus for the fibre-sorting or fibre-selection of a fibre bundle comprising textile fibres, the apparatus comprising:

a fibre-sorting device comprising at least a first roller and a second roller that rotate rapidly without interruption during use, at lease one of the first roller and the second roller having clamping devices distributed about its periphery, the clamping devices adapted to clamp the fibre bundle;

a supply device adapted to supply the fibre bundle to the fibre-sorting device;

at least one mechanical combing device that generates a combing action in order to loosen and remove non-clamped constituents from the fibre bundle;

a take off device adapted to remove combed fibre material from the fibre-sorting device, the take off device comprising a sliver-forming element that forms a combed sliver;

a drafting device;

at least one conveyor element arranged downstream of said sliver-forming element, the conveyor element comprising a driven conveyor belt adapted to convey the combed sliver to said drafting device, the conveyor belt including an intake roller; and a pressure element located close to the intake roller of the conveyor belt, wherein the pressure element is a non-moving surface.

2. An apparatus according to claim 1, wherein the conveyor belt comprises a driven ascending conveyor.

3. An apparatus according to claim 1, wherein the conveyor belt is arranged immediately after the sliver-forming element.

4. An apparatus for the fibre-sorting or fibre-selection of a fibre bundle comprising textile fibres, the apparatus comprising:

a fibre-sorting device comprising at least a first roller and a second roller that rotate rapidly without interruption during use, at lease one of the first roller and the second roller having clamping devices distributed about its periphery, the clamping devices adapted to clamp the fibre bundle;

a supply device adapted to supply the fibre bundle to the fibre-sorting device;

at least one mechanical combing device that generates a combing action in order to loosen and remove non-clamped constituents from the fibre bundle;

a take off device adapted to remove combed fibre material from the fibre-sorting device, the take off device comprising a sliver-forming element that forms a combed sliver;

a drafting device;

at least one conveyor element arranged downstream of said sliver-forming element, the conveyor element comprising a driven conveyor belt adapted to convey the combed sliver to said drafting device; and a sliver-expanding device arranged between the conveyor belt and the drafting system, wherein the sliver-expanding device is adapted to expand the fibre sliver in width to a narrow fibre web.

5. An apparatus according to claim 1, wherein the sliver-forming element comprises delivery rollers, and the intake roller of the conveyor belt is located close to the delivery rollers of the sliver-forming element.

6. An apparatus according to claim 1, wherein the conveyor belt is adapted to compact the fibre sliver.

7. An apparatus according to claim 1, wherein the conveyor belt is adapted to expand the width of the fibre sliver.

8. An apparatus according to claim 1, further comprising devices that limit the width of the fibre sliver, wherein the devices are arranged on both sides of the fibre sliver.

9. An apparatus according to claim 1, wherein more than one fibre sliver is feedable to the at least one conveyor element.

10. An apparatus according to claim 1, comprising two conveyor belts arranged one above the other in the longitudinal direction, the two conveyor belts running obliquely upwards, wherein the two conveyor belts are adapted to convey the fibre sliver upwards, and the two conveyor belts are adapted to press the fibre sliver between said two conveyor belts.

11. An apparatus according to claim 1, further comprising two co-operating calender rollers arranged upstream of the conveyor belt.

12. An apparatus for the fibre-sorting or fibre-selection of a fibre bundle comprising textile fibres, the apparatus comprising:

a fibre-sorting device comprising at least a first roller and a second roller that rotate rapidly without interruption during use, at lease one of the first roller and the second roller having clamping devices distributed about its periphery, the clamping devices adapted to clamp the fibre bundle;

a supply device adapted to supply the fibre bundle to the fibre-sorting device;

at least one mechanical combing device that generates a combing action in order to loosen and remove non-clamped constituents from the fibre bundle;

a take off device adapted to remove combed fibre material from the fibre-sorting device, the take off device comprising a sliver-forming element that forms a combed sliver;

a drafting device; and at least one conveyor element arranged downstream of said sliver-forming element, the conveyor element adapted to convey the combed sliver to said drafting device, wherein the at least one conveyor element comprises a sheet-like element with a non-moving surface.

13. An apparatus according to claim 12, further comprising two co-operating calender rollers, wherein the two calender rollers are mounted immediately upstream of the sheet like element.

14. An apparatus according to claim 12, further comprising two co-operating calender rollers, wherein the sheet-like element is arranged upstream of the two calender rollers.

15. An apparatus for the fibre-sorting or fibre-selection of a fibre bundle comprising textile fibres, the apparatus comprising:

a fibre-sorting device comprising at least a first roller and a second roller that rotate rapidly without interruption during use, at lease one of the first roller and the second roller having clamping devices distributed about its periphery, the clamping devices adapted to clamp the fibre bundle;

a supply device adapted to supply the fibre bundle to the fibre-sorting device;

at least one mechanical combing device that generates a combing action in order to loosen and remove non-clamped constituents from the fibre bundle;

a take off device adapted to remove combed fibre material from the fibre-sorting device, the take off device comprising a sliver-forming element that forms a combed sliver;

a drafting device; and at least one conveyor element arranged downstream of said sliver-forming element, the conveyor element comprising: an ascending conveyor adapted to convey the combed sliver to said drafting device, and a sheet-like element with a non-moving surface, wherein the ascending conveyor is arranged downstream of the sheet-like element.

16. An apparatus for the fibre-sorting or fibre-selection of a fibre bundle comprising textile fibres, the apparatus comprising:

a fibre-sorting device comprising at least a first roller and a second roller that rotate rapidly without interruption during use, at lease one of the first roller and the second roller having clamping devices distributed about its periphery, the clamping devices adapted to clamp the fibre bundle;

a supply device adapted to supply the fibre bundle to the fibre-sorting device;

at least one mechanical combing device that generates a combing action in order to loosen and remove non-clamped constituents from the fibre bundle;

a take off device adapted to remove combed fibre material from the fibre-sorting device, the take off device comprising a sliver-forming element that forms a combed sliver;

a drafting device;

at least one conveyor element arranged downstream of said sliver-forming element, the conveyor element adapted to convey the combed sliver to said drafting device; and a support element with a non-moving surface that supports the fibre sliver, the support element being arranged downstream of the at least one conveyor element.

17. An apparatus according to claim 1, wherein the conveyor belt includes at least one horizontal region and at least one sloped region.

18. An apparatus according to claim 17, further comprising a pressure element arranged above the sloped region, wherein the pressure element presses the ascending fibre sliver onto the conveyor belt.

19. An apparatus according to claim 1, wherein the at least one conveyor element comprises at least two separate conveyor belts.

20. An apparatus for the fibre-sorting or fibre-selection of a fibre bundle comprising textile fibres, the apparatus comprising:

a fibre-sorting device comprising at least a first roller and a second roller that rotate rapidly without interruption during use, at lease one of the first roller and the second roller having clamping devices distributed about its periphery, the clamping devices adapted to clamp the fibre bundle;

a supply device adapted to supply the fibre bundle to the fibre-sorting device;

at least one mechanical combing device that generates a combing action in order to loosen and remove non-clamped constituents from the fibre bundle;

a take off device adapted to remove combed fibre material from the fibre-sorting device, the take off device comprising a sliver-forming element that forms a combed sliver;

a drafting device; and at least one conveyor element arranged downstream of said sliver-forming element, the conveyor element comprising: at least two conveyor belts adapted to convey the combed sliver to said drafting device, and a sheet-like element with a non-moving surface, wherein the sheet-like element is present between the at least two conveyor belts.

21. An apparatus according to claim 1, wherein the first roller comprises a turning rotor and said second roller comprises a combing rotor.

* * * * *